US005461394A

United States Patent [19]

Weber

[11] Patent Number: 5,461,394

[45] Date of Patent: Oct. 24, 1995

[54] DUAL BAND SIGNAL RECEIVER

[75] Inventor: John Weber, Boulder Creek, Calif.

[73] Assignee: Chaparral Communications Inc., San Jose, Calif.

[21] Appl. No.: 263,247

[22] Filed: Jun. 21, 1994

Related U.S. Application Data

[63] Continuation of Ser. No. 42,877, Apr. 5, 1993, abandoned, which is a continuation-in-part of Ser. No. 840,334, Feb. 24, 1992, abandoned.

[51] Int. Cl.[6] ..... H01Q 5/00; H01Q 13/02; H01Q 19/18; H01Q 9/22

[52] U.S. Cl. ..... 343/786; 343/776; 343/818; 343/837

[58] Field of Search ..... 343/756, 786, 343/776, 834, 837, 817–819, 730;

[56] References Cited

U.S. PATENT DOCUMENTS

| | | | |
|---|---|---|---|
| Re. 26,448 | 9/1968 | Ehrenspeck | 343/837 |
| D. 272,910 | 3/1984 | Taggart et al. | 343/786 |
| 2,425,488 | 8/1947 | Peterson et al. . | |
| 2,820,965 | 1/1958 | Sichak | 343/756 |
| 3,086,203 | 4/1963 | Hutchison . | |
| 3,325,817 | 6/1967 | Ajioka et al. | 343/779 |
| 3,438,043 | 4/1969 | Ehrenspeck | 343/819 |
| 3,508,277 | 4/1970 | Ware et al. | 343/786 |
| 3,508,278 | 4/1970 | Ehrenspeck | 343/837 |
| 3,665,481 | 5/1992 | Low et al. | 343/762 |
| 3,731,236 | 5/1973 | Di Tullio et al. | 333/9 |
| 3,864,687 | 2/1975 | Walters et al. | 343/778 |
| 4,041,499 | 8/1977 | Liu et al. | 343/756 |
| 4,414,516 | 11/1983 | Howard | 333/21 A |
| 4,504,836 | 3/1985 | Seavey | 343/786 |
| 4,544,900 | 10/1985 | Howard | 333/21 A |
| 4,740,795 | 4/1988 | Seavey | 343/786 |
| 4,785,306 | 11/1988 | Adams | 343/786 |
| 4,819,005 | 4/1989 | Wilkes | 343/786 |
| 4,821,046 | 4/1989 | Wilkes | 343/786 |
| 4,862,187 | 8/1989 | Hom | 343/786 |
| 4,903,037 | 2/1990 | Mitchell et al. | 343/756 |
| 5,003,321 | 3/1991 | Smith et al. | 343/781 |
| 5,103,237 | 4/1992 | Weber | 343/786 |
| 5,107,274 | 4/1992 | Mitchell et al. | 343/756 |

FOREIGN PATENT DOCUMENTS

| | | | |
|---|---|---|---|
| 9102390 | 2/1991 | WIPO | 343/786 |

OTHER PUBLICATIONS

J. M. Seavey Proper Feed Selection: First Step to Optimum System Performance, TVRO Technology, Aug. 1986, 5 pages.

*Primary Examiner*—William Mintel
*Assistant Examiner*—Peter Toby Brown
*Attorney, Agent, or Firm*—William E. Pelton; Donald S. Dowden

[57] ABSTRACT

A dual band signal receiver is provided with relatively coaxial antenna assemblies electromagnetically coupled to respective upper and lower band rectangular waveguides and ports through suitable polarization switching assemblies. The upper band rotatable antenna assembly consists of a dipole feed having driven dipole elements, parasitic dipole elements and a corner reflector element electromagnetically coupled to the upper band rectangular waveguide by a suitable transmission line extending substantially along the longitudinal axis or centerline of the lower band cylindrical waveguide.

29 Claims, 10 Drawing Sheets

DUAL BAND SIGNAL RECEIVER

This is a continuation of application Ser. No. 08/042,877, filed Apr. 5, 1993 (now abandoned), which is a continuation-in-part of Ser. No. 07/840,334, filed Feb. 24, 1992 (now abandoned).

FIELD OF THE INVENTION

The present invention relates to prime focus antenna feeds for receiving microwave signals transmitted from a satellite geosynahronous orbit about the earth, and in particular to prime focus polarization switches having one antenna responsive to a first frequency range and another antenna responsive to a second frequency range so as to permit simultaneous reception of satellite microwave signals within each of the first and second frequency ranges. The invention has particular use in connection with satellite broadcast "receive only" (TVRO) television systems.

BACKGROUND OF THE INVENTION

Satellite broadcast "receive only" television signals are very weak and require the use of a large antenna with a large collecting area in order to receive a useful signal. It is common for the large collecting area to constitute a paraboloidal reflector dish. The signal collected and reflected by the paraboloidal dish is focused by the reflector surface to a point in front of the dish. The distance of the focal point of any particular dish from the dish is dependent upon the curvature of the reflecting surface of the dish, which is usually paraboloidal.

The signal reflected from the dish is normally detected by a device referred to as a prime focus feed antenna. As will be understood by those skilled in the relevant art, the prime focus feed antenna is located as precisely close to the focal point of the reflector as is possible. The principal function of all prime focus feed antennas is to provide uniform illumination of the paraboloidal reflector surface of the dish without any spillage of energy beyond the outer rim of the reflector surface.

Many different prime focus feed antennas have been used heretofore for such purposes. These include feed antennas such as open waveguides, conical or pyramidal horns, dipoles, slotted waveguide arrays, helix antennas, dielectric rod antennas, microstrip antennas, corrugated circular waveguides and conical horns. These devices provide well documented varying levels of overall performance achieved. While the overall function of receiving and collecting the reflected signal as efficiently as possible is essentially the same for all of these types of antennas, the physical principles and the way by which these different antennas function to produce the desired radiation beam or pattern so as to efficiently illuminate the paraboloidal reflector are not nearly the same and differ widely.

Downlink waveguide equipment is presently characterized by the use of waveguide antennas of the type which are sometimes known as scalar feedhorns. Scalar feedhorns generally consist of a waveguide, the radiating aperture of which is surrounded by one or more concentric grooves. The grooves may be peripheral corrugations formed within the radiating aperture of the waveguide or they may be concentrically placed around the outside of the aperture. The nature, number and placement of such corrugations depend upon the particular requirements of the system in which the waveguide is to be used. Until fairly recently, TVRO satellite signals have been transmitted principally in the operating frequency band of from 3.7 to 4.2 GHz, an operating band referred to by persons in the field as the C-band. C-band waveguide antennas are positioned at the focal point of a suitable paraboloidal reflector dish and such antennas have had to demonstrate superior performance characteristics for reception of TVRO signals at C-band. This has been due, for the most part, to the relatively low power at which C-band signals are transmitted from the orbiting satellites used to transmit such television information. The most commonly used scalar rings for C-band TVRO communications are those shown in U.S. Pat. No. Des. 272,910 to Taggart et al., owned by the assignee of the present invention.

In the past few years, some TVRO satellite channels have, for many reasons, also been transmitted at frequencies within the range of from 10.95 to 12.75 GHz, a frequency band referred to by persons in the field as the Ku-band. Thus, some satellite television stations are transmitted in the C-band range, while others are transmitted in the Ku-band frequency range. Accordingly, it had become desirable prior to 1986 for TVRO earth stations to have system components capable of receiving and processing both C-band and Ku-band signals simultaneously without the components used to receive at one frequency interfering with the efficiency of the signal reception at the other frequency.

Prior types of dual frequency feed assembly used heretofore have consisted of C-band and Ku-band waveguides arranged together in a common feed assembly so that at least one of the waveguides is offset from the boresite of the parabolic reflector. Such devices adequately received C-band and Ku-band signals simultaneously but were relatively expensive and occasionally yielded inconsistent reception quality due to offset phase centers of the C-band and Ku-band waveguide apertures.

Accordingly, it has been understood in the TVRO art since at least about 1986 (and in related commercial art long before that) that substantially common phase centers for dual frequency feed assemblies may be achieved by the use of concentric waveguides, the smaller higher frequency waveguide being located coaxially with respect to the larger lower frequency waveguide. There has developed heretofore a proliferation of TVRO and other microwave waveguide junctions consisting of coaxial waveguides for simultaneous reception of multiple frequency ranges.

For example, U.S. Pat. No. 3,864,687 to Walters et al. describes a coaxial horn antenna provided with three cylindrical waveguides 12, 14 and 16 which are progressively sized to provide an inner radiating aperture 18, a concentric intermediate aperture 20 and a concentric outer aperture 22 at the front end of the assembly. The beamwidths of the frequencies propagated within these waveguides are controlled by stepping the forward ends of the horns, with the inner horn projecting furthest. The phase centers of the concentric waveguides are purportedly substantially constant over the band of coverage.

U.S. Pat. No. 3,665,481 to Low et al. discloses a multi-frequency feed assembly for use with a single dish reflector. The feed assembly consists of a plurality of coaxial waveguide pipes including a circular inner pipe 16 for receiving the highest frequency signal, an intermediate pipe 18 and an outer pipe 20 for receiving the lowest frequency. The space between the intermediate pipe 18 and the outermost pipe 20 defines a coaxial tracking waveguide 21 containing inwardly projecting probes. Illumination of the dish reflector is effected efficiently by the use of an outer flared horn section 12 for the tracking waveguide and an outer flared horn section 44 for the inner highest frequency waveguide 16. In this arrangement, the innermost and highest frequency waveguide 16 is spaced from all the walls of the surrounding lower frequency waveguide region 21.

U.S. Pat. No. 3,086,203 to Hutchison discloses a waveguide structure for multiple frequencies having an outer circular waveguide 10, a cylindrical core 16 and an inner circular waveguide 22. The cylindrical core and the outer circular waveguide define a coaxial region 18 therebetween. Lower frequency signals are coupled into the coaxial region 18 and are detected therein by probes extending radially into the coaxial space. The coaxial region propagates the coaxial TE11 mode. The inner waveguide 22 propagates signals of a different frequency without interfering with signals in the coaxial region 18. A probe 30 couples signals from the inner waveguide to a receiver 32.

U.S. Pat. Nos. 4,819,005 and 4,821,046 to Wilkes show similar dual frequency microwave feed assemblies for use with a parabolic reflector. Both patents show coaxial circular waveguides where the higher frequency waveguide is disposed in and concentric with the surrounding lower band waveguide. The diameters of the waveguides are adjusted so that the innermost waveguide does not degrade the performance of the lower frequency surrounding waveguide. The preferred frequencies are the C and Ku frequency bands for satellite communications.

U.S. Pat. No. 3,508,277 to Ware et al. discloses the use of two cylindrical waveguides mounted coaxially with respect to each other. Flared horns are provided at the ends of the waveguides for feeding multiple signals to a common load such as a parabolic reflector dish. The patent discloses an inner circular waveguide for transmission of the signals in the upper frequency band and an outer circular waveguide for transmision of the signals in the lower frequency band. Ware et al. deliver the higher frequency signal directly out the back wall of the surrounding lower frequency waveguide.

U.S. Pat. No. 3,325,817 to Ajioka et al. appears to show a dual frequency feed assembly in which a higher frequency pyramidal horn 10 is mounted coaxially within a surrounding lower frequency pyramidal horn 12. The higher frequency horn 10 is centered along the longitudinal axis 14 of the lower frequency horn 12. The signal may be transmitted from (or received by) the higher frequency horn 10 which is spaced from the sidewalls of the surrounding lower frequency waveguide and extends longitudinally through the lower frequency waveguide to deliver the higher frequency signal through the rear wall 24 of the lower frequency waveguide. The presence of the higher frequency waveguide within the lower frequency waveguide along the longitudinal axis of the latter so as to space the former from the sidewalls of the latter provides an uninterrupted signal path for the lower frequency signal, which is detected by a pair of lower frequency probes 26 and 28 located near the rear wall of the lower frequency waveguide 12. The phase centers of the higher and lower frequency feed horns are selected to be as nearly coincident as possible, given the tolerances of the particular reflector systems employed. (Col. 3, lines 7–10).

U.S. Pat. No. 2,425,488 ("'488 patent") to Peterson et al. also discloses the use of a pair of coaxial and concentric pyramidal waveguides for simultaneously receiving signals at different frequencies. The axes of both feed horns coincide. A high frequency pyramidal horn is situated within the interior of a surrounding low frequency pyramidal horn such that the high frequency pyramidal horn is separate or spaced from all of the walls of the low frequency pyramidal horn. The high frequency signal is coupled out laterally through the sidewall of the low frequency waveguide thereby leaving an open waveguide space behind the high frequency waveguide in which a low frequency pick-up probe 24 is located. In the embodiment shown there is added structure in the form of partitions 28 and 29 which provide uniform uninterrupted signal paths for the low frequency signal around the high frequency waveguide. (Col. 2, lines 44–46). The low frequency signal thereby passes around the high frequency feedhorn to the low frequency pick-up probe 24, which is located just in front of the rear wall 25 of the low frequency waveguide. The partitions on the upper and lower sides of the high frequency waveguide are to provide for a smooth electrical path for the low frequency energy to get to the back of the low frequency waveguide for detection by the probe 24. Although the partitions 28,29 physically block part of the open space along the sides of the high frequency waveguide, it would be obvious to use dielectric partitions to support the coaxial high frequency waveguide in an application where the uninterrupted signal path for the lower frequency signal might preferably be annular or coaxial in cross section (i.e., to support a coaxial TE11 mode) such as when circular waveguides are used in place of the pyramidal horns, for certain applications mentioned hereinbelow. By way of example, were the waveguides disclosed in Peterson et al. to be circular in cross section, the space within the low frequency waveguide behind the high frequency waveguide and between the rear wall 25 and the rear point of the higher frequency waveguide would constitute a circular waveguide section and therefore support the dominant TE11 circular waveguide mode common in TVRO applications.

U.S. Pat. No. 4,041,499 ("'499 patent") to Liu shows a dual frequency feed similar to that of Ajioka et al. but which uses coaxial circular waveguides instead of pyramidal horns. Liu et al. disclose a waveguide antenna in which inner and outer waveguides are side-fed by fixed coaxial probes. The inner waveguide is fed with a monopulse signal in the sum or in-phase mode and the outer waveguide is similarly side-fed with a monopulse signal in the difference or out-of-phase mode. In fact, the presence of the circular higher frequency waveguide in Liu et al. defines an uninterrupted signal path for the lower frequency signals in the form of a coaxial transmission line cavity within the surrounding lower frequency waveguide that extends to the rear wall of the lower band assembly. This means that the dominant mode present in the lower band waveguide is the TE11 coaxial waveguide mode.

U.S. Pat. No. 4,785,306 ("'306 patent") to Adams shows a Ku band circular dielectric rod waveguide coaxially mounted in a lower frequency circular waveguide and spaced from all the walls of the surrounding lower frequency waveguide. In this patent, the signal on the coaxial dielectric rod is coupled into a cavity waveguide by bending the dielectric rod at approximately 45 degrees and letting it pass through the side wall of the surrounding lower frequency waveguide. The end of the rod is tapered to provide for efficient launching of the signal into the Ku-band cavity waveguide. The dielectric rod is bent at a 45 degree angle in order to minimize reflections of the C-band signals within the C-band circular waveguide, thus rendering the coaxial Ku-band feed essentially transparent to C-band signals. This patent teaches the use of a Ku-band waveguide coaxially mounted to be spaced from all of the walls of a surrounding lower frequency circular C-band waveguide and the use of a signal transmission means to couple the signal from the coaxially mounted Ku-band waveguide through the side wall of the C-band waveguide. In this arrangement, the C-band signal is detected by a probe situated at the rear of the C-band waveguide in the space behind the coaxial Ku-band waveguide. The C-band signal has an uninterrupted signal path around the Ku-band waveguide to the polarization switch at the back of the C-band waveguide.

An important requirement in a dual frequency feed assembly for frequency re-use satellite systems, and in particular in connection with TVRO systems, is that the system be able to detect signals having different, usually orthogonal, polarizations. One way to meet this objective is to provide components able to switch, upon demand, from one polarization of the incoming signal to the other. For example, this requirement has given rise to the common use in TVRO prime focus feeds of a small rotatable metal probe assembly located at the bottom or back of the waveguide and coupled electrically to the relevant standard rectangular waveguide. Such a probe assembly and feed horn for use at C-band is shown and described in U.S. Pat. No. 4,414,516 to Taylor Howard, owned by the assignee of the present application, although the probe assembly of the '516 Howard patent may be suitably scaled to work at any desirable frequency. The foregoing '306 patent to Adams suggests the use of rotatable probes for the purpose of polarization switching.

U.S. Pat. No. 4,740,795 ("'795 patent") to Seavey (of record in applicant's parent application) discloses a dual frequency coaxial feed assembly for receiving electromagnetic signals at two different frequencies and conveying them to an external signal utilization device. The feed assembly consists of a waveguide for C-band signals having a circular aperture at one end and being closed at the other end. A rotatable dipolar probe is mounted at the closed end of the C-band waveguide for receiving C-band signals entering and propagating within the waveguide from the aperture. The probe, which is within a circular C-band waveguide section, couples the C-band signal to a rectangular waveguide section mounted on the exterior of the C-band waveguide housing. From the rectangular waveguide section, the C-band signal is appropriately amplified and processed. A Ku-band circular waveguide cavity and circular aperture is coaxially and concentrically mounted within the surrounding C-band circular waveguide. This structure enables simultaneous reception of both the C-band and Ku-band frequency ranges. The Ku-band waveguide is smaller in diameter than the surrounding C-band waveguide and it is spaced from all of the working walls of the C-band waveguide. The Ku-band signal is coupled out of the Ku-band circular waveguide by a rotatable dipolar probe element which is supported by dielectric means within the cavity. The Ku signal is coupled through a suitable transmission means to a rectangular waveguide section mounted on the exterior of the C-band waveguide casting. The rotatable dipolar probes are connected to rotate together on a common axis within their respective waveguides. In this Seavey patent, the C-band cavity consists of two portions: a coaxial annular portion surrounding the Ku-band waveguide and a circular waveguide portion behind the Ku-band waveguide in which the rotatable C-band probe is located. The two portions are electrically interconnected by four coaxial lines so that C-band signals incident at the C-band aperture have an uninterrupted signal path through the coaxial C-band cavity around the Ku-band waveguide and into the circular C-band cavity containing the C-band probe detector.

U.S. Pat. Nos. 4,903,037 ("'037 patent") and 5,107,274 to Mitchell et al. (of record in applicant's parent application) and International Application No. PCT/US90/04356 (WO 91/02390) to Blachley (of record in applicant's patent application) describe essentially the dual frequency feed assembly of Seavey in which a pair of circular waveguides 14 and 16 are coaxially mounted such that the smaller higher frequency waveguide 16 is within the larger lower frequency waveguide 14. The waveguides are designed to operate simultaneously in the C and Ku-band frequency ranges. The larger C-band waveguide 14 contains antenna probe 33 to detect the C-band signals and the smaller Ku-band waveguide 16 contains antenna probe 20 to detect the Ku-band signals. Each antenna probe 33 and 20 is coupled to a respective waveguide section 41 and 31 to couple the signals to an external amplifier. In contrast to Seavey, Mitchell et al. and Blachley mount their Ku-band waveguide by means including a coaxial line for coupling the Ku-band signal to the exterior of the C-band waveguide casting. Mitchell et al. and Blachley also utilize a cumbersome harp structure to rotate the entire Ku-band assembly, which includes the probe fixed therein, for polarization switching.

Mitchell et al. and Blachley describe their central purpose as being to avoid degredation of the C-band signals by making the Ku-band cavity substantially "transparent" to C-band. This is seen to be accomplished in two ways: (1) by adjusting the length of the Ku-band waveguide assembly, and (2) by empirically establishing an optimum axial position for the Ku-band assembly within and spaced rearwardly or inwardly from the C-band aperture plane. With respect to the first technique, the '037 patent discloses that the Ku-band cylinder or assembly is approximately 1.6 inches long. (Col. 4, lines 57–59). This length is approximately one-half wavelength of the propagating C-band signal within the surrounding C-band waveguide. With a length near 1.6 inches the Ku assembly operates on the fundamental principal of a "halfwave plug" provided that it is positioned somewhat inwardly of the C-band aperture, as shown in FIGS. 2 and 5–7 of the '037 patent. Under these circumstances, it is well known in the relevant art that, as a halfwave plug, the Ku-band assembly is rendered essentially invisible, or reflection free, by a familiar consequence of two equal, but oppositely phased, reflections. One reflection arises within the C-band cavity at the input side of the assembly and the other substantially equal and cancelling reflection arises at the output side, 1.6 inches further down the C-band cavity. The two reflections essentially cancel each other thereby rendering the Ku-band assembly of 1.6 inches in length essentially invisible to the C-band signals within the waveguide. As shown by Mitchell et al. in FIGS. 8 and 9 of the '037 patent, this placement of the Ku-band assembly inwardly of or "behind" (Col. 4, line 13) the C-band aperture opening has produced an enhancement of the C-band performance relative to such performance in the absence of the Ku assembly. (Col. 4, lines 31–38).

In the structure disclosed by Mitchell et al., moreover, the signal from the Ku-band circular waveguide is coupled to a coaxial transmission line that passes substantially radially or laterally outward from the Ku-band waveguide and through the side wall of the C-band waveguide. In this respect, Mitchell et al. and Adams ('306 patent) disclose well known equivalent structures for the purpose of coupling signal away from the Ku-band waveguide. Mitchell et al. use a radially extending coaxial line and Adams uses a nearly radially extending dielectric rod. As in the '306 patent to Adams, the existence within the Mitchell et al. C-band cavity of the laterally extending Ku-band transmission line prevents one from drawing a line with a pencil completely around the outside of the higher frequency feed horn assembly without being interrupted by the transmission line.

Accordingly, Mitchell et al., and Adams disclose coaxial feed assemblies in which the higher frequency feed is spaced from the walls of the surrounding lower frequency waveguide, except for the connecting link represented by the transmission line carrying the higher signal to the exterior of the feed assembly.

Seavey ('795) does not differ in substance from these structures. Seavey happens to use a waveguide cavity, as does Peterson et al. ('488 patent) to convey the detected Ku-band signal to the exterior of the lower frequency waveguide. Seavey simply selected, as a matter of choice, a different partition arrangement for mounting the Ku-band (higher frequency) waveguide within and spaced from the working walls of the C-band (lower frequency) waveguide. In all these structures the mounting means for the Ku-band waveguide is essentially invisible to the C-band signal.

For waveguide assemblies of the type disclosed by Mitchell et al., Seavey ('795) Adams or Peterson et al., moreover, the dominant C-band signal mode is reflected from the rear wall of the C-band circular waveguide to produce a standing wave configuration within the waveguide. The pick-up probe within the waveguide is located at a standing wave maximum to provide efficient coupling or excitation of the mode with or by the probe. This reflection from the rear wall and the location of the probe within the C-band waveguide do not affect the radiation pattern established by the feed assembly.

Finally, Mitchell et al. mount the Ku-band signal launch box on the scalar rings making the illumination characteristics of the feed unadjustable. Accordingly, the mechanism disclosed by Mitchell et al. lacks a means for lowering the noise temperature of the device in response to varying installation parameters.

Ideally, a feed assembly should have a radiation pattern such that it radiates toward the parabolic reflector to illuminate the entire surface with little or no spillage, or loss of radiation around the sides of the reflector. As has been demonstrated by the art disclosed above, the most common choice of a feed assembly for a parabolic reflector is the waveguide. Antennas, L.V. Blake, September 1991, Munro Publishing Company, pp. 264–265.

The radiation pattern of the waveguide is established by the physical size of the aperture opening of the waveguide and the electric field established at that opening. For example, in waveguides of the type utilized by Mitchell et al., the beam of radiation used to illuminate the paraboloidal reflector is dependent upon the electric field established in the aperture of the waveguide by the TE11 mode that is incident on the waveguide aperture. Thus the surface area defined by the aperture rim is in fact the most important working wall of the waveguide. Energy of the appropriate frequency undergoes a transition upon being incident at that surface or wall of the waveguide.

In such waveguide feeds the TE11 mode can be excited by a variety of different means such as by a probe of the type disclosed by Howard or by coupling signal energy into the circular waveguide by means of another waveguide using slot coupling, as in Ware et al., or other means. Such different means for exciting the TE11 mode can be located at any arbitrary distance from the aperture and these means and where they are located have no effect on the radiation pattern produced by the circular waveguide aperture with an incident TE11 mode. It is only the physical size of circular aperture and the electric field established at the aperture by the incident TE11 mode that determines the radiation pattern of a waveguide assembly.

Contrary to the functioning of waveguides, a dipole antenna does not have a radiation pattern focused by a physical aperture and is known to be ill-equipped to the task of illuminating a reflector dish with a focused radiation pattern, as is desirable at the TVRO frequencies of interest. Sometimes a double-dipole endfire array may be used. Blake, supra. But these have been found useful only at significantly lower frequencies than Ku-band and have not been known to work in dual frequency feed assemblies. S. Silver, Microwave Antenna Theory and Design, Vol. 12 of MIT Radiation Laboratory Series, McGraw-Hill, New York, 1949. The dipole array of the present invention therefore cannot be said to have been known or suggested in the art known heretofore.

Another of the important requirements in a feed assembly for a dual frequency, frequency re-use satellite system is that the feed assembly have low cross-polarization characteristics. This is important because of the dual polarized nature of TVRO satellite signals and the relatively closely spaced broadcast satellites in orbit around the earth. Cross-polarization is undesirable because of the possible existence of co-channel cross-talk caused by substantial interference between signals at the same frequency but having orthogonal polarization characteristics.

Whether an antenna assembly has suitable low cross polarization feed characteristics is a complicated function of the particular antenna with which one is concerned. In general it is necessary to have substantially equal E and H plane patterns, i.e., rotational symmetry, in order to achieve low cross-polarization characteristics.

It is understood in the relevant art that the circular waveguide, particularly with the proper mode and a corresponding aperture diameter, provides very good rotational symmetry in its radiation pattern and resulting low cross-polarized feed characteristics. In circular waveguide feeds, the cross-polarization characteristics depend on the relative size of the circular aperture in terms of the relevant wavelength, and upon the mixture of modes that one excites in the aperture of that circular waveguide. Accordingly, it has become recognized in the art that in circumstances where cross polarization cannot be tolerated, such as is generally the case in TVRO reception, circular waveguides having an aperture diameter approximately equal to one wavelength of the frequency of interest are especially usefull because such circular waveguides have been shown to exhibit rotationally symmetrical radiation patterns and relatively low cross polarization characteristics. Such circular waveguides have accordingly come into wide use in TVRO applications.

In contrast, the dipole antenna is well understood to have a radiation pattern that is not rotationally symmetrical and therefore exhibits relatively poor cross-polarization characteristics. As stated above, the dipole has been known heretofore to represent a relatively poor choice for use in a TVRO feed assembly.

Where dipoles have been included heretofore in connection with broadcast television reception from satellites they have mostly appeared as dipolar probes within waveguides, as in the foregoing '795 patent to Seavey and (in some embodiments) U.S. Pat. No. 4,504,836 ("'836 patent") to Seavey. As a further example, U.S. Pat. No. 4,862,187 to Hom (of record in applicant's parent application) discloses the use of dipole elements in a feedhorn for a satellite dish. Hom discloses a feedhorn 10 having a metallic housing 12 which defines a throat 18 formed within a metallic cup 20. Dipole antenna elements 38,40 are situated within the cup 20 which constitutes a waveguide. Thus, the radiation pattern and cross polarization characteristics of the assembly of Hom are determined by the waveguide aperture.

Where dipole antennas have been used heretofore as feeds without a waveguide they have not been seen in dual band assemblies nor to function suitably for TVRO. The '836 patent to Seavey discloses the use of a particular dipole antenna for C-band operation in a single band feed. In one embodiment, the dipole 15 is within and near the rear wall of a circular waveguide 12. In such an embodiment, the radiation pattern and cross-polarization characteristics of the feed would be determined essentially by the nature and function of the waveguide. In another embodiment, as shown in FIGS. 7 and 9, the depth of the circular waveguide cavity is reduced (Col. 4, lines 18–19) and the dipole with its elements drooped is placed outside the face of a corrugated ring structure. Without substantial influence of a waveguide, the corrugated ring structure is required to shape the radiation pattern of the feed. However, good cross polarization results from this embodiment are unlikely in light of FIG. 8 which shows cross polarization in the H plane of this embodiment at about –20 dB when it should theoretically be zero. Even in the 45 degree plane, where the cross polarization lobes are usually a maximum, the desired value for frequency re-use systems should be below –30 dB in order to avoid TV picture interference. Seavey fails to provide cross polarization levels in the 45 degree plane and the levels he does provide do not appear suitable. Thus the Seavey '836 patent does not disclose or suggest the use of the dipole array of the present invention, and especially does not suggest the use of a dipole array in a dual band feed.

SUMMARY OF THE INVENTION

In contrast to the foregoing, the present invention provides a dual band prime focus feed assembly, preferably for TVRO reception, which comprises a Ku-band antenna feed consisting of an array of interactive elements including a driven dipole together with specific parasitic elements. Significantly, the Ku-band dipole feed of the present invention does not use a waveguide. The Ku-band dipole feed and surrounding C-band waveguide are substantially coaxial and have commonly driven rotatable assemblies which couple the signals to respective launch boxes mounted substantially adjacent the bottom or rear wall of the C-band waveguide. The Ku-band dipole feed eliminates the high-band waveguide and probe assembly within the surrounding low-band waveguide, as has been known in the art heretofore. Means are provided for conducting the Ku-band signal to its respective launch box along substantially the central axis of the C-band waveguide and to the back wall thereof so as to minimize any disturbance of the C-band electric field and any substantial contribution to the noise temperature of the device. In fact the presence of the dipole array and its signal conductor extending substantially concentrically through the C-band waveguide creates or defines a coaxial waveguide for the lower frequency C-band signal in which the coaxial, not circular, TE11 waveguide mode is dominant throughout the C-band waveguide. The absence of a circular C-band cavity and circular TE11 mode in the C-band cavity means, in effect, that the dipole feed assembly of the present invention is not spaced from all the walls of the C-band waveguide.

The dipole feed of the present invention preferably consists of an array comprising a driven dipole, a parasitic dipole and a corner reflector. The desired radiation pattern of the dipole array of the present invention is established as a result of the dimensions of and spacing between the driven dipole elements and the parasitic reflector elements of the array. In contrast to waveguide assemblies, the dipole feed of the present invention does not have a physical circular aperture with an electric field established by an incident TE11 mode and does not have a circular Ku-band waveguide. The TE11 mode cannot exist in free space where the Ku-signal is detected by the dipole and does not exist along the transmission path from the dipole to the launch box. The TE11 mode exists only within a waveguide and in accordance with this invention, no circular waveguide is used for detection of the Ku-band signal. The Ku-band dipole feed of the present invention does not contain a probe and does not work in the same way as the probe used heretofore with waveguides to excite or couple to the TE11 mode in the waveguide. Moreover, providing a launch box for the Ku-band signal at the rear of the device contributes to assembly efficiency and permits full illumination adjustment of suitable corrugations of scaler rings which may be mounted around the periphery of the radiating apertures.

In one embodiment, the Ku-band signal is extracted from the Ku-band dipole antenna through a coaxial transmission line which extends substantially parallel to and adjacent the longitudinal axis of the C-band waveguide, thereby creating a coaxial line cavity within the C-band waveguide for propagation of the C-band signal. In this respect, the cavity for the C-band signal in a feed having the present invention is not properly considered to constitute a circular waveguide cavity.

The transmission line exits through the rear wall of the C-band coaxial waveguide and couples to the Ku-band launch box preferably mounted in the webbing between the C-band waveguide and its associated waveguide launch box. The preferred arrangement provides for low production cost, a minimum number of component parts and, due to its light weight and standard size, facilitates in-the-field replacement of standard C-band feeds.

BRIEF DESCRIPTION OF THE PREFERRED EMBODIMENTS

Figure 1:
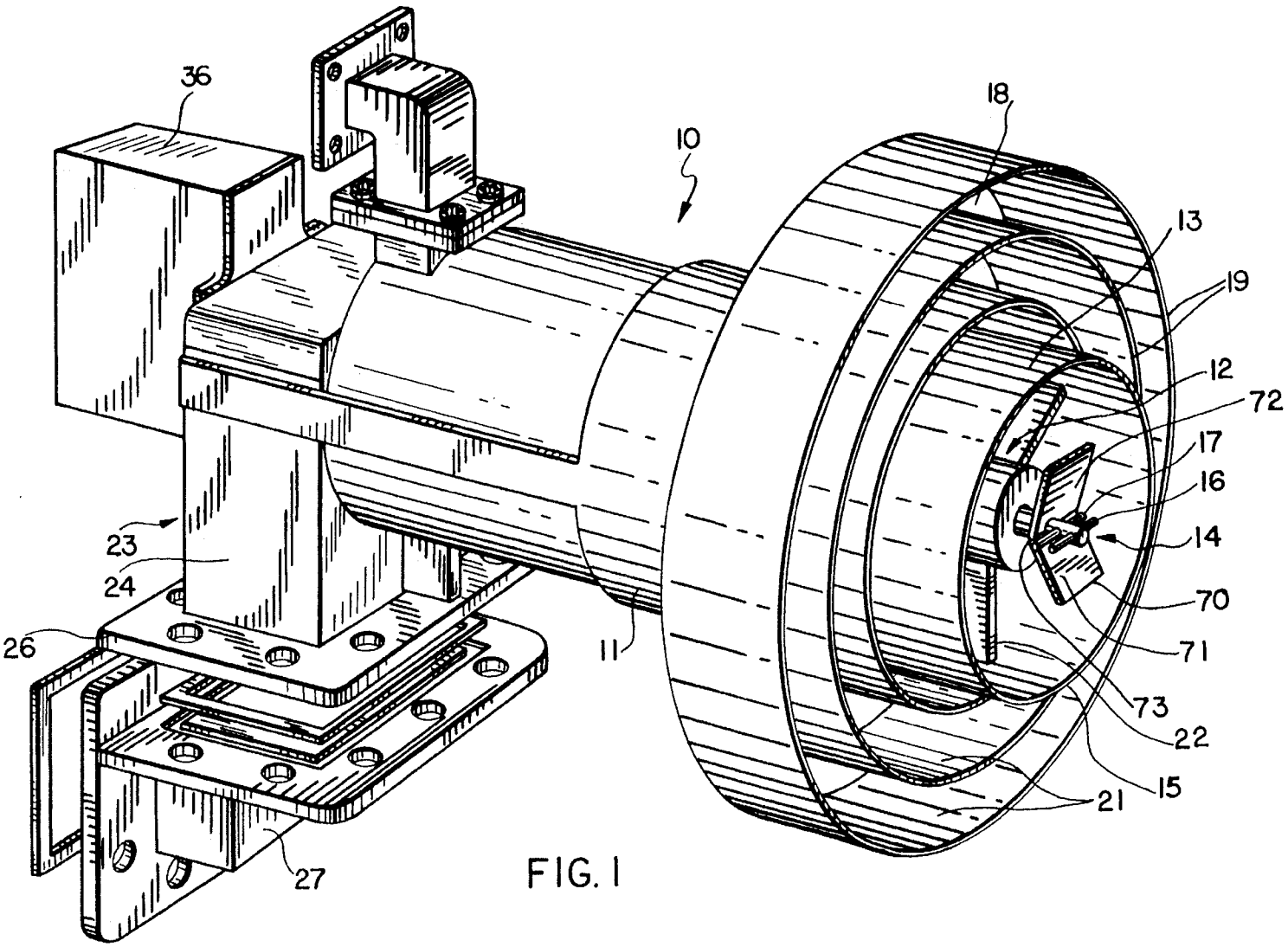
FIG. 1 is a perspective view of a dual band signal receiver of the present invention showing a two element yagi type dipole antenna array with parasitic dipole elements and corner reflector.

Referring now to the drawings, and in particular to FIG. 1, there is shown a dual frequency signal receiver 10 which consists of a first signal receiving assembly 11 and a second signal receiving assembly 12 mounted coaxially therewith. In the preferred embodiment, the first signal receiver assembly 11 consists of a standard cylindrical waveguide portion 13 of circular cross-section sufficient to permit propagation therein of a selected mode for microwave signals in the relatively low-band frequency range of from 3.7 to 4.2 GHz, known as the C-band for TVRO transmissions.

The second signal receiver assembly, or feed, 12 is not a waveguide and consists of an array 14 of electrically interactive conductive elements which are sized and spaced so as to cooperate to receive microwave signals within the relatively high-band frequency range of from 11.7 to 12.2 GHz, known as the Ku-band for TVRO transmissions. The array 14 consists in part of a first pair 16 of oppositely extending antenna arms which comprise a two-element yagi type dipole antenna. The arms 16 are in-line oppositely extending active or driven elements 16 in the form of small rods having a length scaled to the Ku frequency band of interest. A second pair 17 of oppositely extending antenna arms is spaced from and positioned directly behind and parallel to the driven arms 16. The arms comprising the second pair of antenna arms are parasitic elements preferably having substantially the same size and shape as the driven elements 16. In some circumstances, however, it may be preferable for each of the parasitic arms 17 to be slightly longer than and to protrude beyond the outer end of the corresponding one of the driven pair of dipole arms 16. The relative lengths of the driven and parasitic arms of the dipole feed may be determined to meet desired performance criteria.

Figure 2:
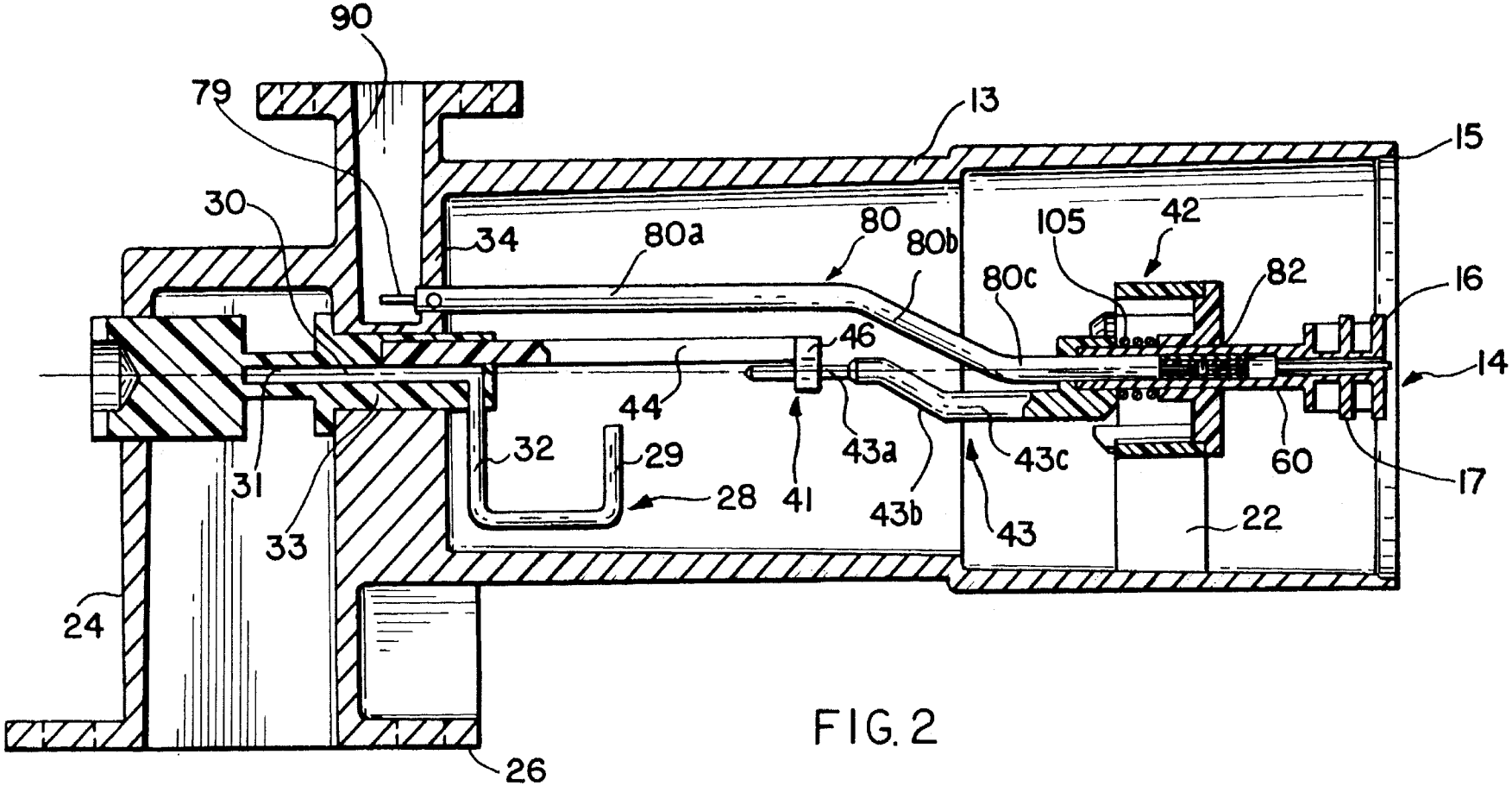
FIG. 2 is a side elevation sectional view of the embodiment of the invention depicted in FIG. 1.
Figure 7A:
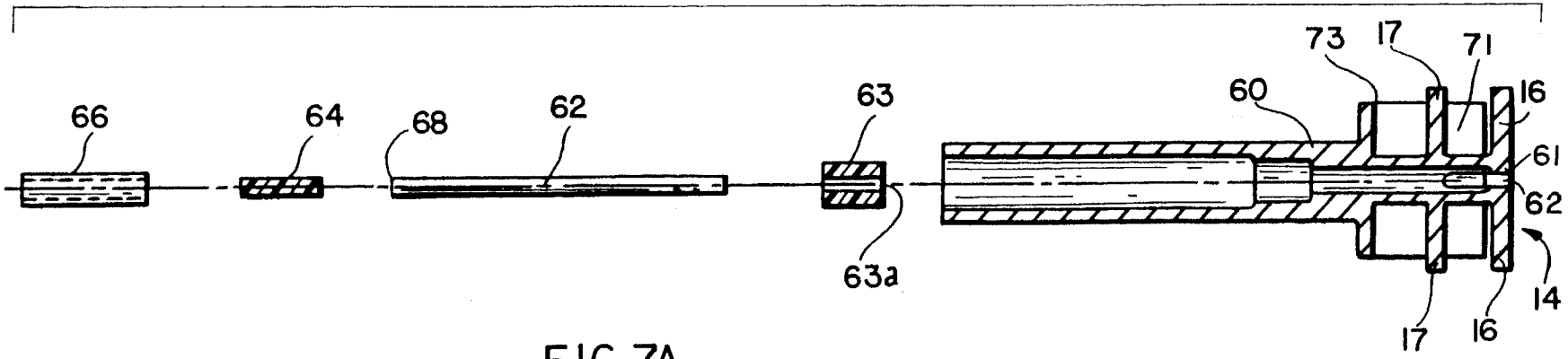
FIG. 7A is a detail section of a portion of the dipole array of the present invention in exploded format.
Figure 8A:
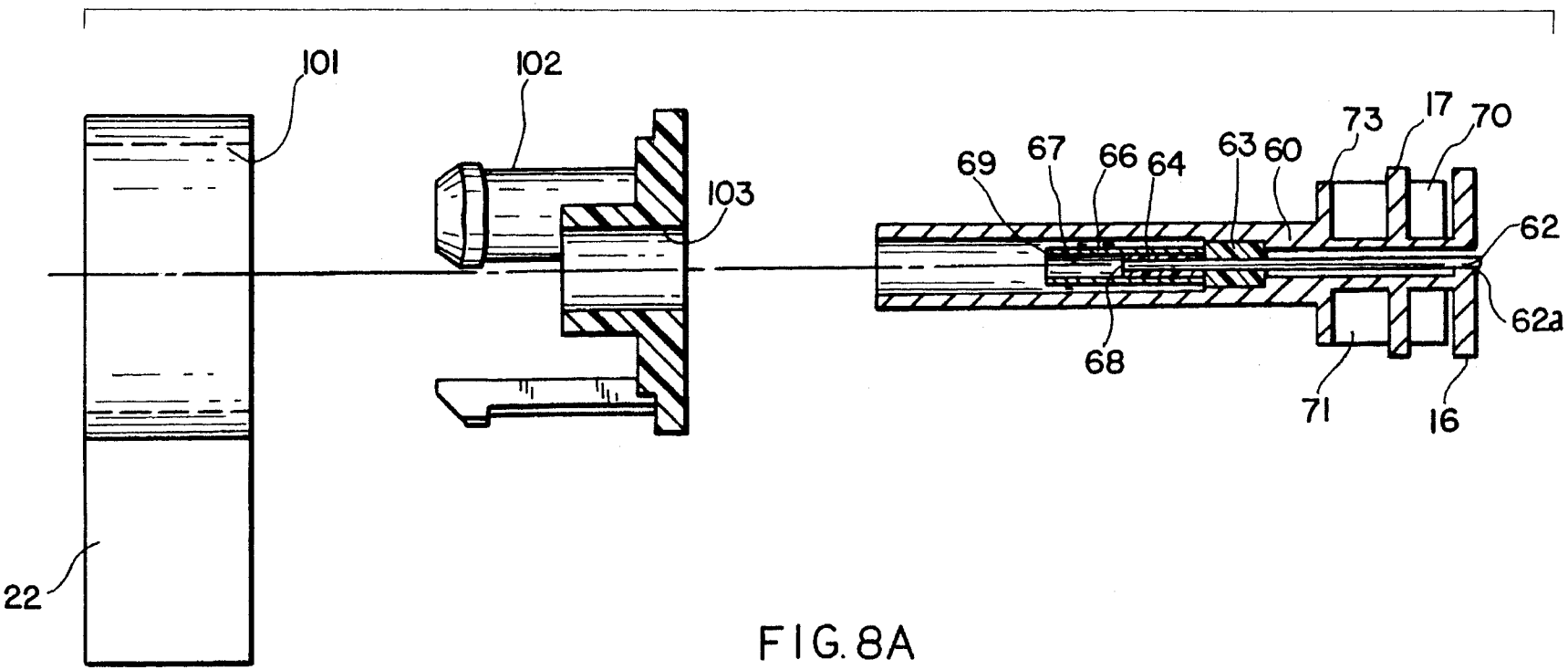
FIG. 8A is an exploded view of the support section for the dipole array of the present invention.

With reference to FIG. 2, and as shown in more detail in the exploded view of FIG. 7A and the assembled view forming part of FIG. 8A, the driven arms 16 and the parasitic arms 17 may be formed as part of a conductive, hollow and substantially tubular metal casting 60. The casting 60 is grooved at its outer end along its longitudinal axis on diametrically opposite sides, as shown by reference numeral 61 (FIG. 7A), to define a known type of balun feed for the driven dipole arms 16. A conductive feed wire 62 extends longitudinally through the center of the casting 60, parallel to the grooves 61, and is conductively connected at one end, for example by soldering (as at 62*a*), to one of the driven dipole elements 16, as shown in the assembled view of FIG. 8A. With respect to FIGS. 7A and 8A, a plastic insulator 63 having a central bore 63*a* through which the feed wire 62 is positioned may be used to support the feed wire 62 within and to insulate it from the casting 60 itself. A plastic sleeve 64 fits over the free end or pin 68 of the feed wire 62 to insulate the pin from and to secure it by friction to an interior portion of a larger diameter metal sleeve 66. The sleeve 66 is secured over and surrounds the pin 68 of the wire 62 but is positioned so that a portion of the sleeve extends concentrically away from the pin leaving a space 67 within the sleeve between the pin 68 and the distal end 69 of the sleeve. As will be readily understood by those skilled in the art, the sleeve 66 is one-half wavelength long (at Ku-band) and its purpose and that of the space 67 therein is to define a half-wave rotary joint, as will be explained in further detail below.

Referring to FIGS. 1, 7A and 8A, the dipole array 14 also consists of a flat reflector plate 70 which is fixedly attached to, or may be formed as part of the casting 60 and has a planar surface 71 adjacent and parallel to each of the parasitic dipole arms 17. A second planar surface 72 (FIG. 1) is part of a second flat reflector plate and it too is adjacent and substantially parallel to the parasitic dipole arms 17. In the preferred embodiment, the two planar surfaces 71 and 72 meet at a corner 73 and together define what is understood in the art to constitute a corner reflector. In the present arrangement, the corner 73 lies parallel to and directly behind the parasitic reflector arms 17.

The distances between the driven dipole arms 16, the parasitic dipole arms 17, the surfaces 71 and 72 and the corner 73 are selected to faciliate the establishment of a desirable radiation pattern for the Ku-band array, which does not have the advantage of a circular waveguide for such a purpose. The parasitic and driven elements of the dipole array function in a known manner through radiation interference to enhance radiation in the forward direction and, in effect, to cancel it in the rearward direction. This reflection action through wave interference is crucial to the production of a suitable radiation beam or pattern efficiently to illuminate the paraboloidal reflector.

With reference to FIG. 1 and in accordance with standard practice, the low-band receiver 11 is a pipe or waveguide having a physical opening or aperture defined by the rim 15 of waveguide 13. The waveguide 13 may also be provided with an annular metal choke plate 18 at or near the periphery of its aperture. A plurality of forwardly projecting concentric corrugations or metal rings 19, referred to as scalar rings, may be placed in spaced apart positions on the forward facing surface of the choke plate 18. The rings 19 define a plurality of concentric grooves 21, the number, width and depth of which may vary, as desired. In most instances, the choke plate 18 is slidably arranged on the periphery or outer circumference of the low-band waveguide 13 and releasably held in the desired location by suitable set screws (not shown). Adjustment of the position of the choke plate and rings relative to the radiating aperture of the waveguide has been found useful in shaping the radiation of illumination pattern of the signal receiver. However, the choke plate and annular rings have sometimes been formed of a single casting together with the cylindrical waveguide 13 and therefore may not be adjustable relative to the waveguide 13 and its aperture 15.

The dipole array 14 is preferably mounted at the aperture 15 of the C-band signal receiver 11 substantially coaxially therewith along its centerline. In order that the phase center for the C-band waveguide 13 and the phase center for the Ku-band dipole array 14 are substantially the same, the array 14 is mounted so that the driven dipole arms 16 are substantially at the plane containing the rim 15 defining the aperture to the C-band waveguide, as shown in FIG. 2. In this way, the operation of the Ku-band dipole feed is not in any way affected by the presence of the larger C-band waveguide feed.

Means such as a plastic centering or throat support 22 are provided for positioning and securing the dipole array 14 in place. The throat support 22 may take any desired configuration including a butterfly or spider arrangement having a plurality of spaced apart legs, as desired. The configuration of and the plastic material of the throat support 22 are selected so as to minimize any disturbance of the microwave electric field conducted through the radiating aperture of C-band waveguide 13 and yet to enable low cost and reliable reproduction. The plastic material for the throat support 22, for example, is preferably a castable form of plastic having low loss electrical characteristics, such as plastic manufactured by General Electric Corp. and sold in connection with the trademark (LEXAN).

With reference to FIG. 1, the C-band assembly 11 generally consists of the cylindrical waveguide portion 13 and a rectangular waveguide sub-assembly, generally indicated by reference numeral 23. It has been known heretofore to cast the waveguide 13 and the sub-assembly 23 either separately for subsequent interconnection or together in a single casting, as desired. The sub-assembly 23 comprises a C-band rectangular launch box 24 preferably situated just behind the bottom or rear wall of the cylindrical waveguide 13. The launch box 24 is typically a standard rectangular WR229 waveguide having a port and flange 26 adapted for standard interconnection with an elbow transition 27 to a suitable LNA. The WR229 waveguide may be cast together with the cylindrical waveguide 13 in a single casting, or separately cast and suitably joined to the cylindrical waveguide, as desired.

Figure 6A:
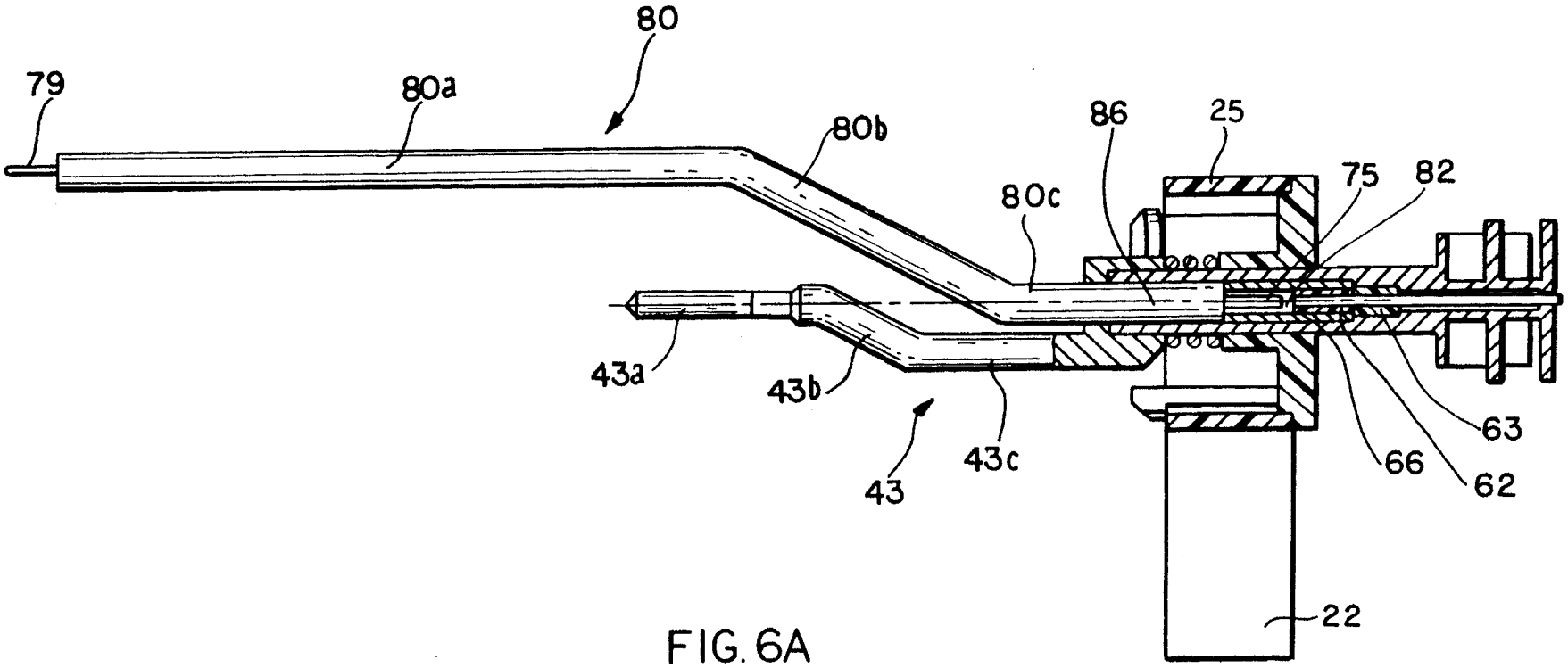
FIG. 6A is an exploded view of a portion of the dipole antenna arrangement showing a rotary joint, rotary drive elements and coaxial cable.
Figure 6B:
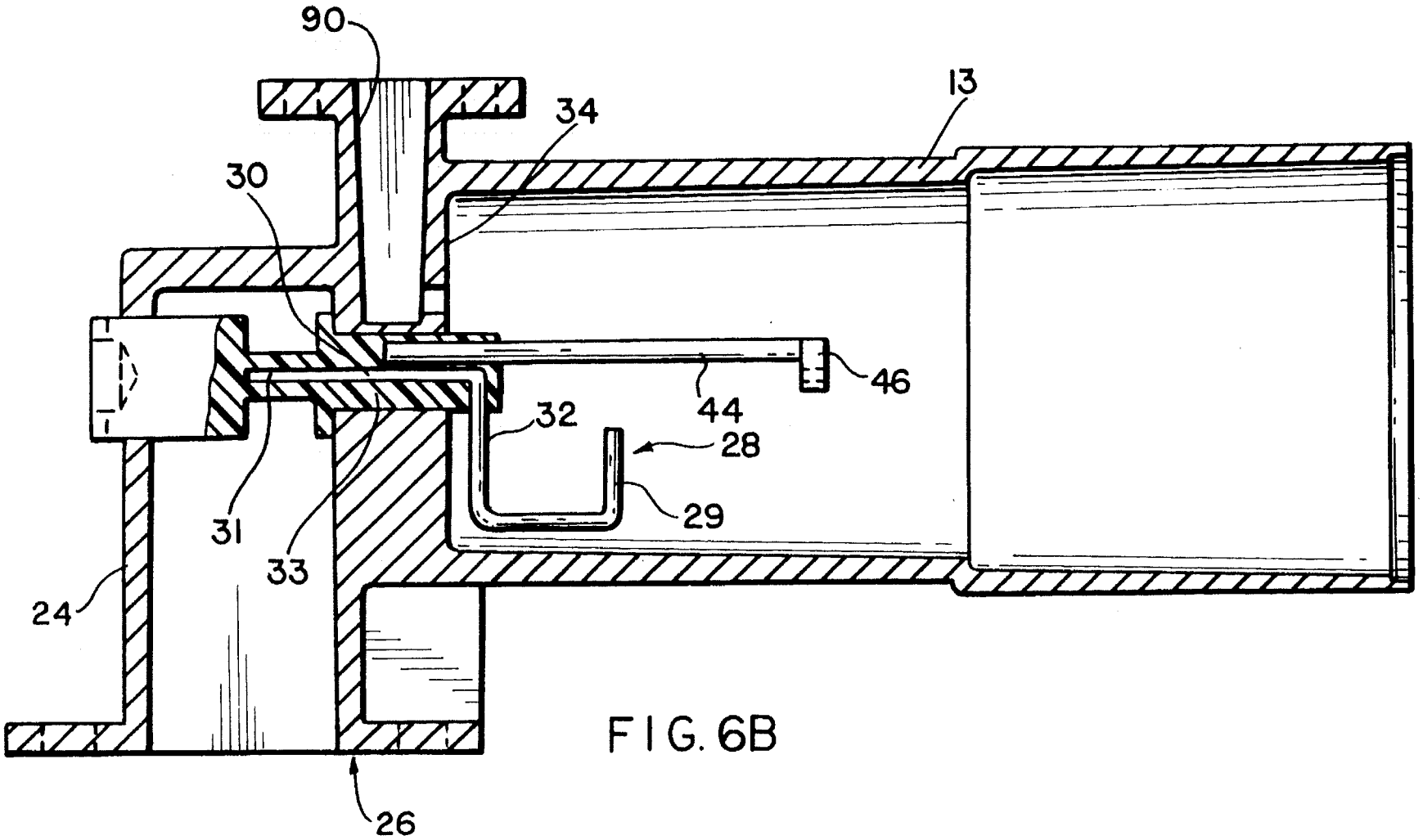
FIG. 6B is a side elevation sectional view comprising the remainder of the exploded view of FIG. 6A and showing the low-band waveguide in which the dipole is to be mounted.

With reference to FIGS. 2 and 6B, the polarization switch of the C-band receiver for TVRO reception is preferably a small rotatable metal probe assembly, generally indicated by reference numeral 28. The probe assembly 28 preferably consists of a pair of probes 29 and 31 interconnected by a transmission line section 32. The probe assembly set forth in U.S. Pat. No. 4,414,516 to H. Taylor Howard has been found to be particularly desirable for TVRO reception because of its exceptionally low-loss characteristics. Other types of rotatable probes, whether monopole or dipole, may, however, be used for C-band reception within the C-band waveguide 13 with adequate results.

In the preferred embodiment, the probe assembly 28 is fixed into a cylindrical plastic drive shaft or holder 33 which extends through the cavity of the WR229 waveguide 24 in a direction substantially perpendicular to the direction of propagation of energy therein. The probe assembly 28 is held in the drive shaft holder 33 such that a portion 30 of the transmission line 32 of the probe assembly extends along the rotational and longitudinal axis of the holder 33, as does the probe 31. The holder 33 extends through the side wall of the WR229 waveguide and through the back or rear wall 34 of the waveguide 13 to terminate just inside the latter. Rotational movement is imparted to the holder 33 by a suitable servo motor 36 (FIG. 1) mounted on the outside of the WR229 waveguide 24. A suitable plastic material for the holder 33 is preferably that which is manufactured by Oak Materials Group Inc. and sold in connection with the trademark (REXOLITE) because it is an insulating material having a styrene base known for its low-loss characteristics at the frequency ranges of interest. The rotational axes of the holder 33 and probe assembly 28 are substantially coincident with the centerline or longitudinal axis of the cylindrical waveguide 13. The probe 31 launches the C-band signal in the WR229 waveguide in the same direction regardless of the polarization status of the signal. The probe 29 moves back and forth within the C-band waveguide 13 in a plane perpendicular to the longitudinal axis of the waveguide.

Because of the polarization characteristics of Ku-band broadcast signals reflected by the parabolic reflector dish, the driven dipole arms 16 of the dipole array 14 are preferably rotatable for the purpose of polarization switching. In the present embodiment, the arms 16 are rotated by rotating the entire dipole array. The structure of the preferred embodiment for rotating the dipole array is depicted in various forms in FIGS. 2, 3, 6A, 6B and 8B. Referring to FIG. 2, the Ku-band dipole array 14 is provided with a rotatable drive assembly indicated generally by reference numeral 41. As shown in more detail in FIGS. 2, 3 and 6B, the drive assembly 41 consists of a first plastic extension element, or lower drive bar 44, eccentrically and fixedly mounted at one end into the plastic rotatable holder 33 for the C-band probe assembly 28. The lower drive bar 44 is mounted into the holder 33 from within the C-band waveguide and preferably extends parallel to and as close as reasonably possible to the centerline or longitudinal axis of the waveguide 13. The plastic material of the lower drive bar 44 is again selected to ensure low-loss electrical efficiencies and low cost manufacturing efficiencies. For this reason, a castable plastic insulating material is preferred. One such suitable plastic material is manufactured by Hoechst Celanese Corp. and sold in connection with the trademark (DUREL). In this embodiment, it is desirable that the lower drive bar 44 not have a large cross section and thus, to preserve suitable rigidity, it extends only part way into the waveguide 13 in the direction of and toward the Ku-band dipole array 14.

As shown in FIGS. 2, 3, 6A and 8B, the drive assembly 41 also consists of a second plastic drive element, or upper drive bar, 43 which may be formed as an integral extension of the Ku-band dipole array 14. In the preferred embodiment, however, the upper drive bar 43 engages but is not integral with the dipole assembly and extends within the C-band waveguide 13 in a direction towards the free end of the lower drive bar 44. DUREL brand plastic may also be used for the upper drive bar.

Figure 3:
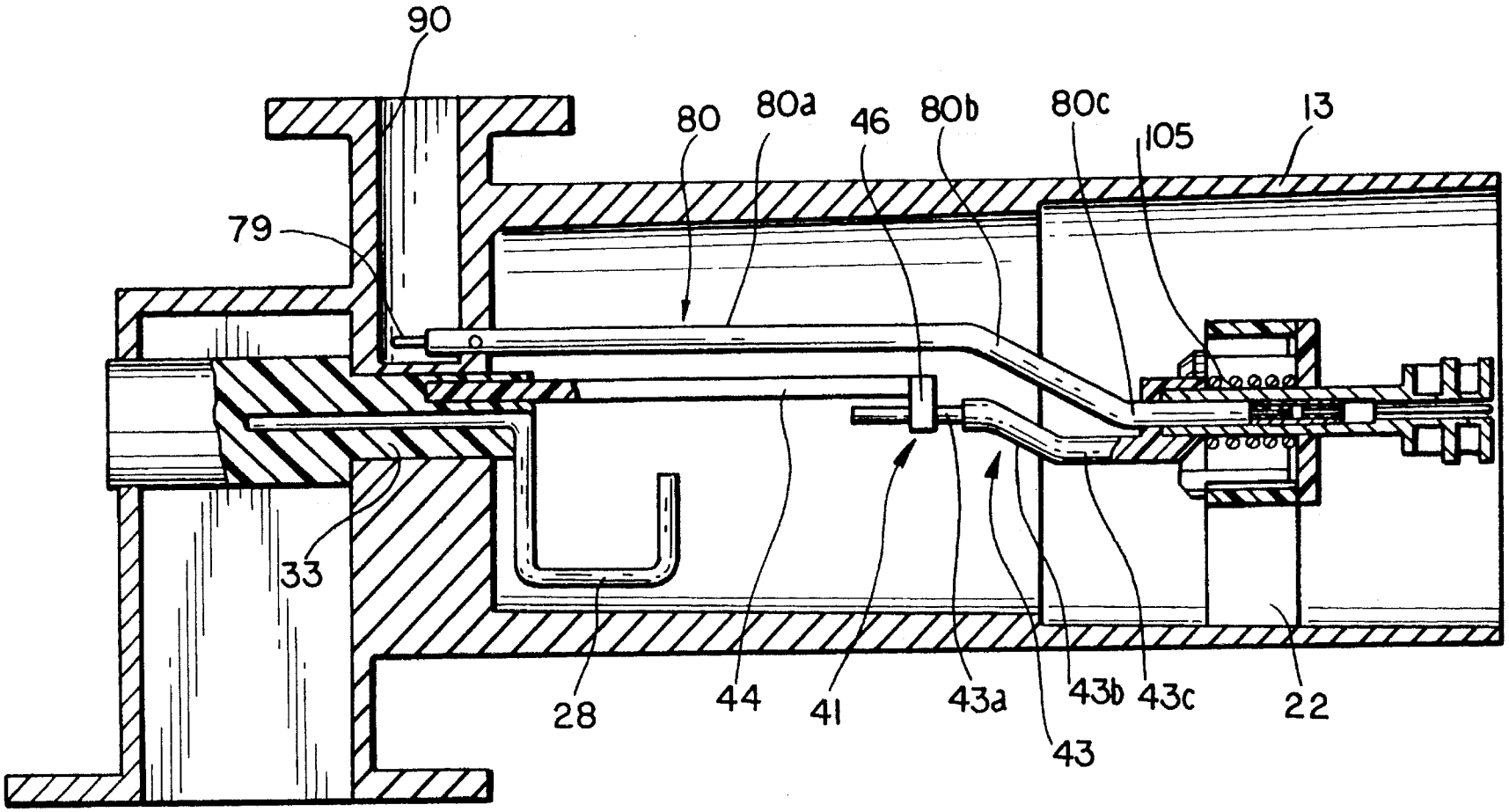
FIG. 3 is a side elevation sectional view similar to FIG. 2.
Figure 4:
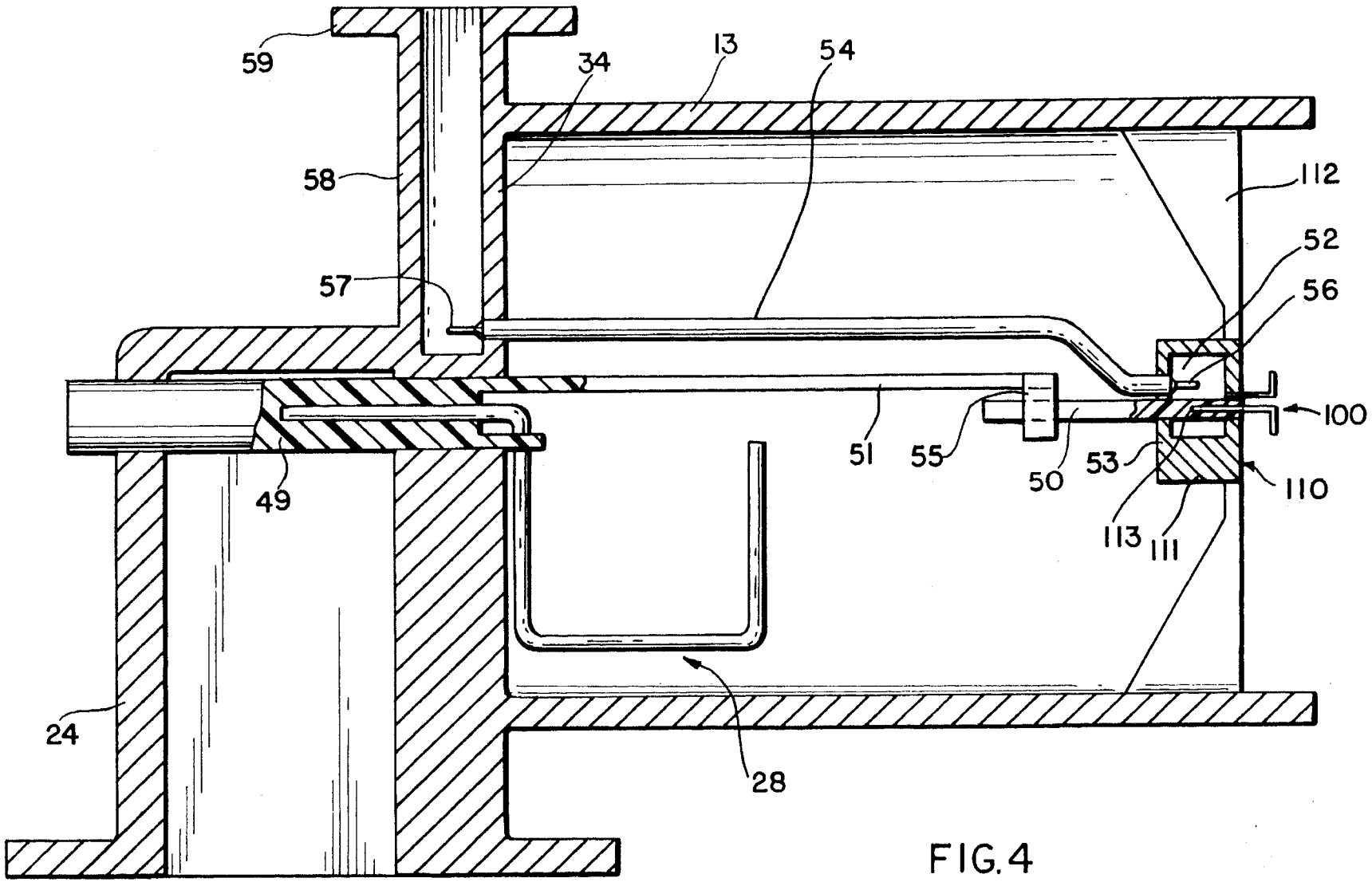
FIG. 4 is a side elevation sectional view of another embodiment of the present invention.

The upper drive bar may be collinear with the rotational axis of the dipole array and with the centerline of the C-band waveguide 13, as shown schematically at 50 in the alternate embodiment of FIG. 4. Alternatively, with reference to FIG. 6A, the upper drive bar 43 may be provided with an offset bend by which a portion 43*a* is concentric with the centerline of the C-band waveguide 13 and another portion 43*c* extends parallel to and slightly below the centerline of the C-band waveguide. The offset portions 43*a* and 43*c* are joined by a rigid interconnecting link 43*b*. Such an arrangement is depicted in FIGS. 2, 3, 6A, and 8B.

Since the lower drive bar 44 is offset slightly relative to the longitudinal axis of the C-band waveguide, the drive bars 43 and 44 may be offset relative to each other. Accordingly, a small interconnector member 46 may be employed rigidly to tie together the juxtaposed ends of each of the drive bars 43 and 44. The interconnector 46 may be formed integrally with the lower drive bar 44 to define a single shaft and adaptor, as shown in FIG. 6B. Accordingly, polarization switching of both the low-band and high-band antenna assemblies may be accomplished by the same servo motor 36. The drive bars 43 and 44, as well as the connector 46 are preferably made of the DUREL brand low-loss plastic, but other materials may be suitable according to the desires of those skilled in the relevant art.

Other techniques may be utilized by those skilled in the relevant art for drivingly interconnecting the high and low-band antenna assemblies so that they rotate together. For example, a single drive shaft may comprise a continuous cylindrical protrusion (not shown) extending toward and connected directly to the high-band dipole feed substantially along the centerline of the waveguide 13. Other and various techniques of obtaining simultaneous rotation of the high and low-band antenna assemblies may be used without departing from the scope of the invention, subject only to practical cost restrictions and to the requirement that loss and noise temperature of the resulting device be at an absolute minimum.

Referring now to FIGS. 2, 3, 6A, 7B and 8B, the Ku-band signal which is extracted from free space by the dipole array 14 is coupled out of the dipole feed by a fixed length of coaxial transmission line 80. The transmission line 80 extends substantially coaxially and nearly concentrically relative to the longitudinal axis of the C-band waveguide 13 from the dipole feed to the rear wall 34 of the C-band waveguide. In the present embodiment, the transmission line 80 is shaped somewhat like the upper drive bar 43. That is, it contains a portion 80*a* substantially parallel to the longitudinal axis of the C-band waveguide and a portion 80*c* (seen best in FIGS. 7B and 8B) which lies substantially along the longitudinal axis of waveguide 13, and may be parallel to offset portion 43*c* of the upper drive bar 43. The portions 80*a* and 80*c* are interconnected by offset portion 80*b*.

The portion 80*a* of the transmission line 80 is elongated and traverses the rear wall 34 of the C-band waveguide. The center conductor 79 of the coaxial line extends from one end of the coaxial line, as shown in FIGS. 2, 3, 6A, 7B and 8B, into a rectangular Ku-band waveguide or launch box 90 mounted at the rear of the casting for the C-band waveguide, as shown in FIGS. 2, 3 and 6B. The Ku-band signal is launched by the conductor 79 into the rectangular waveguide 90. From the waveguide or launch box 90, the Ku-band signal is coupled to downline signal processing circuits, which do not form part of the present invention.

Figure 7B:
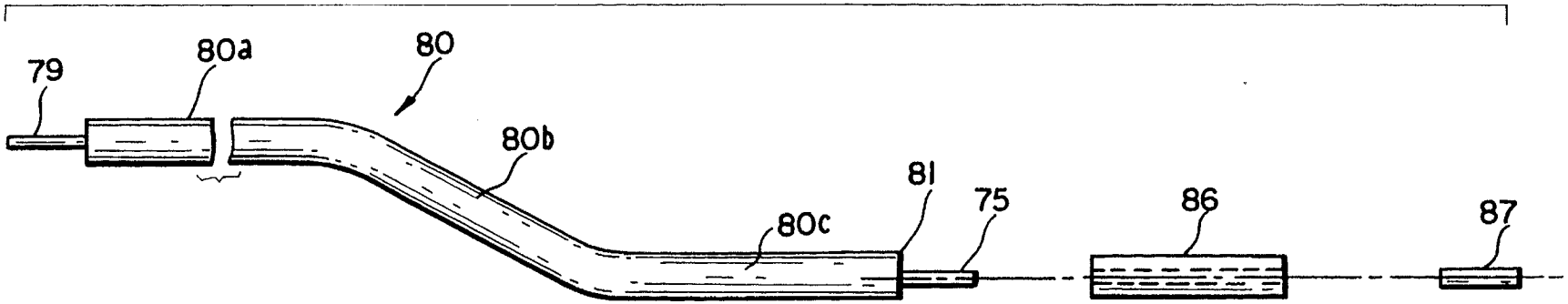
FIG. 7B is a detail section of the Ku-band coaxial cable and coupling elements forming the remainder of the exploded view of FIG. 7A.
Figure 8B:
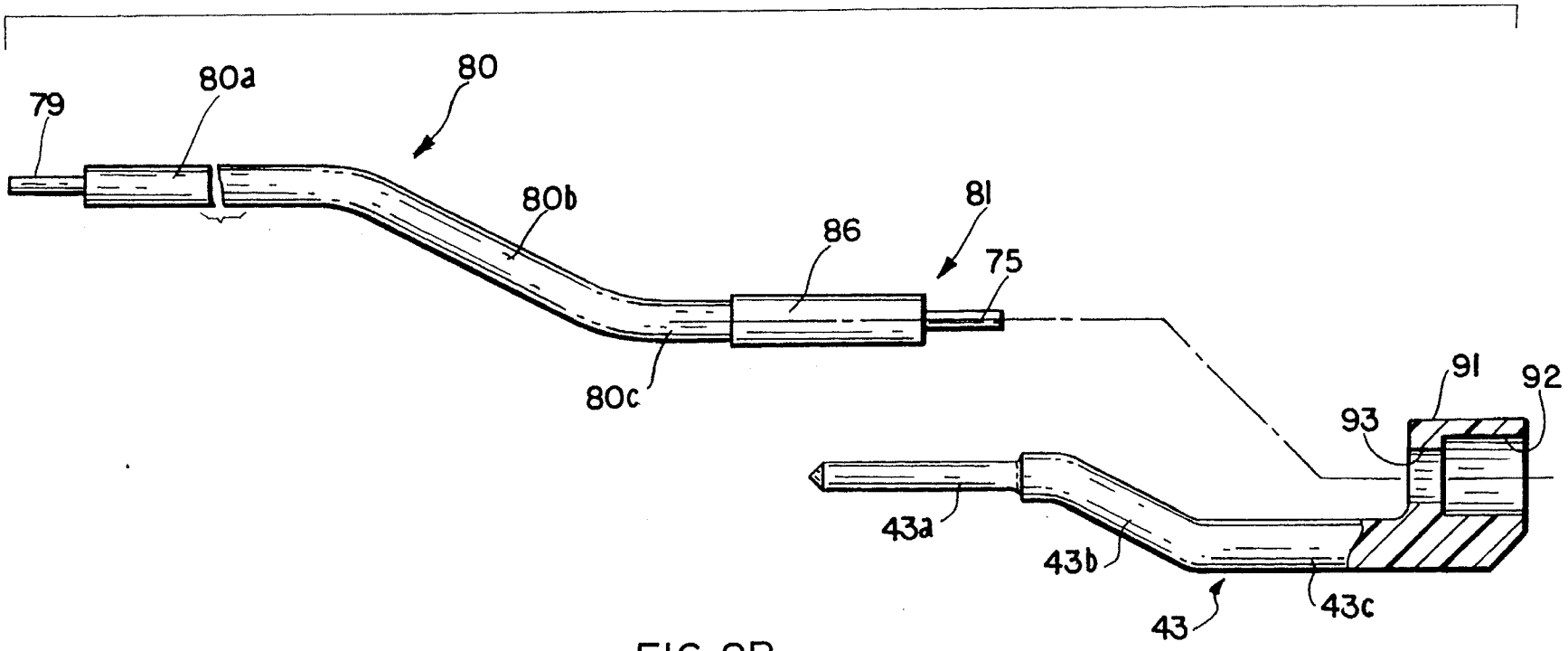
FIG. 8B is a side elevation partially in section of drive elements and transmission line elements for coupling to the antenna elements of FIG. 8A.

With reference to FIGS. 7B, 8A and 8B, the other end 81 of the transmission line 80 contains the protruding center conductor or pin 75 which is adapted to be electrically interactive with the dipole feed pin 68 of the Ku-band conducting feed wire 62 which, as described above, is conductively connected, as at 62*a*, with one arm of the driven dipole arms 16. As mentioned above, in the preferred embodiment the electrical interconnection between the center conductor pin 75 and the feed pin 68 of conducting wire 62 constitutes a half-wave rotary joint. This is accomplished by placing such pins in closely spaced-apart juxtaposed relationship within the confines of the surrounding half-wave metal sleeve 66, as shown in FIGS. 7A and 8A. This arrangement defines a gap 82, seen best in FIGS. 2 and 6A, between the juxtaposed pin 75 of the coaxial center conductor and pin 68 of the Ku-band feed wire. Accordingly, the feed wire 62 of the dipole array may rotate with the array about its longitudinal axis relative to the fixed pin 75 of the coaxial transmission line 80. The microwave signal is nevertheless conducted between the pins without loss of efficiency in accordance with well understood microwave principles.

Various mechanical techniques may be utilized by those skilled in the relevant art for maintaining the gap 82 between the coaxial line pin 75 and the feed pin 68. The technique employed within the preferred embodiment of the present invention is best understood from FIGS. 7B and 8B. As shown in these figures, the end 81 of the coaxial transmission line 80 may be provided with a plastic sleeve 86 of just slightly larger diameter than the diameter of the coaxial line 80 and which remains in place as result of an appropriate friction fit. A smaller plastic sleeve 87 may be fit over the protruding pin 75.

Referring now to FIG. 8B, the offset portion 43*c* of the upper drive bar 43 may be provided with an enlarged but hollow nub section 91 containing a central bore 92. The bore 92 is preferrably of stepped internal diameter, having a reduced diameter portion 93 at the internal end juxtaposed to the end 81 of the transmission line 80. The reduced diameter portion 93 corresponds to the diameter of the plastic sleeve 86. The coaxial line 80 and its sleeve 86 pass through the reduced diameter portion 93 and into the bore 92. As shown in FIG. 2, the bore 92 also receives the distal end of the tubular casting 60 for the dipole feed.

The assembled rotary joint is shown in FIG. 6A. The metal sleeve 66 is situated between the insulator 63, associated with the tubular casting 60, and the plastic sleeve 86 associated with the end 81 of the coaxial line 80. The length of the metal sleeve 66 is such that the gap 82 is maintained at all times between the center conductor pin 75 and the feed pin 68. It will be understood by those skilled in the art that those juxtaposed pin portions 75 and 68 define, in effect, quarter-wave stubs within the sleeve 66.

Referring now to FIG. 8A, the plastic throat support 22 is provided with a central bore 101 into which a plastic holder member 102 may be snap fit. The holder member 102 contains a central bore 103, the purpose of which is rotatably to receive the tubular casting 60 of the dipole feed when the device is fully assembled. Upon assembly, the tubular casting 60 and its dipole feed is free to rotate within and relative to the snap fit holder 102 and the throat support 22. The tubular casting 60 is preferrably substantially collinear with the centerline of the C-band waveguide 13 and with the rotational axis of the C-band probe assembly 28. Thus, as indicated above and seen from FIG. 2, the C-band probe assembly 28 and the Ku-band dipole feed may be rotated together for polarization switching upon rotation of the probe holder 33 by the servo motor 36. A stainless steel compression spring 105 (FIGS. 2,3) may be utilized within the plastic housing defined by the snap-in portion 103 (FIG. 8A) and the plastic support 22 in order to retain the dipole feed in its proper axial position. It will be understood by those skilled in this art, that the position of the dipole feed relative to the fixed plastic support 22 could be established by many other techniques such as a dielectric washer or dielectric sleeve between the front face of the mounting spider and the rear surface of the corner reflector.

With reference to FIG. 4, there is shown an alternate embodiment of the dual band receiver of the present invention. In this embodiment, a dipole feed 100, represented schematically, may be mounted over a flat metal back plane 110 which is part of a waveguide coupler 111 mounted in coaxial position at the aperture of the C-band waveguide 13 within a plastic support 112. The waveguide coupler 111 contains a small enclosed rectangular waveguide cavity 52. The feed line 113 from the dipole feed extends into the cavity 52 as does the center conductor of the Ku-band coaxial signal conductor line 54. The protrusion of the center conductor of the coaxial line 54 into the interior of the cavity 52 forms a coupling probe 56 which extends substantially parallel to and is spaced from the feed wire 113. Ku-band waveguide signals are thereby coupled out of the high-band dipole feed and are transformed to coaxial mode for extraction along the coaxial transmission line 54. The Ku signal is coupled from the feed line 113 to the coaxial line 54 within the cavity 52 by means which will be understood by those skilled in the relevant art.

As shown schematically, the dipole feed 100 is mounted by a suitable upper drive bar 50 which itself traverses the back wall 53 of the waveguide coupler 111. The upper drive bar 50 extends concentrically within the C-band cavity and is connected to a lower drive bar 51 extending from a rotatable probe holder 49. The drive bars 50 and 51 may be interconnected by connecting element 55.

The coaxial cable 54 is fixedly mounted to and also extends through the wall 53 of the waveguide coupler 111.

The line 54 extends from the back wall of the coupler 111 through the interior of the C-band waveguide 13. It is preferably positioned substantially parallel to and adjacent the longitudinal axis or centerline of the C-band waveguide 13 to minimize disturbance of the low-band electric field. In the preferred embodiment, the line 54 is at least semi-rigid to minimize any tendency to vibrate or the like when the signal receiver is subject to environmental stresses.

The coaxial line 54 passes through the rear wall 34 of the C-band waveguide substantially adjacent the point of entry of the probe assembly 28 and terminates in a launch probe 57 (FIG. 4) within a rectangular high-band launch box 58. In the present embodiment, the Ku-band launch 58 constitutes a standard rectangular waveguide of the type known as WR75. This waveguide terminates in a port flange 59 adapted for connection to a suitable elbow transition (not shown) to an LNA. The WR75 waveguide is preferably mounted behind the rear wall of the C-band waveguide 13 but in front of the C-band WR229 waveguide 24, essentially in the webbing of the low-band feed horn between the cylindrical waveguide 13 and the WR229 launch box 24.

In all embodiments of the present invention, the WR229 and WR75 waveguides are situated so as to launch or propagate signals in substantially opposite directions, although the direction of launch is subject to modification without departing from the scope of the invention. The WR75 waveguide may be formed as part of the same casting as the C-band feed horn, or may be separately cast and mounted on the feed horn, as desired. Alternatively, the WR229 and WR75 waveguides may be formed as a single unit casting and mounted on the C-band feed horn, or the entire dual frequency receiver may be a single casting. These alternatives may be adopted by persons skilled in the art without departing from the scope of the invention. The presence of the WR75 waveguide at the back of the C-band waveguide adjacent the WR229 waveguide has been found particularly advantageous. It permits the Ku-band coaxial transmission line to be oriented in a direction substantially perpendicular to the electric field in the C-band feed horn thereby minimizing loss or noise which might otherwise result from disturbance of the field. It also provides cost reduction alternatives and does not interfere with the desirable adjustability of the choke plate 18 and rings 19 (FIG. 1) relative to the radiating aperture 15 of the C-band waveguide to optimize the illumination pattern of the device to suit the particular size and configuration of the reflector dish with which it is used.

In some circumstances, it is desirable to receive or transmit circular polarization. For this purpose a dielectric insert may be diametrically and fixedly mounted within the circular waveguide 13 intermediate the probe assembly 28 and the C-band aperture 15. Such a dielectric and its orientation relative to the C-band cavity is disclosed in U.S. Pat. No. 4,544,900, the description as to which is incorporated herein by reference. A suitable dielectric insert is slab-like or planar having a thickness less than its width. Where desirable, such a dielectric can be substantially U-shaped with the open end of the "U" facing the probe assembly 28. The legs of the U may be shaped, as having a diminishing diameter in stepwise fashion, if desired. The dipole feed assembly may be mounted within the slab, thus eliminating the need for the plastic spider 22. The dielectric slab can be mounted at any appropriate angle with respect to the vertical, in FIG. 1 for example. The orientation of the slab at 45° to the electric field is well understood in the art. The purpose of such a dielectric block is to produce the necessary field conversion to enable use of the dual frequency receiver with circularly polarized modes of signal transmission. The use of such slabs or blocks does not affect the scope of the present invention.

Figure 5:
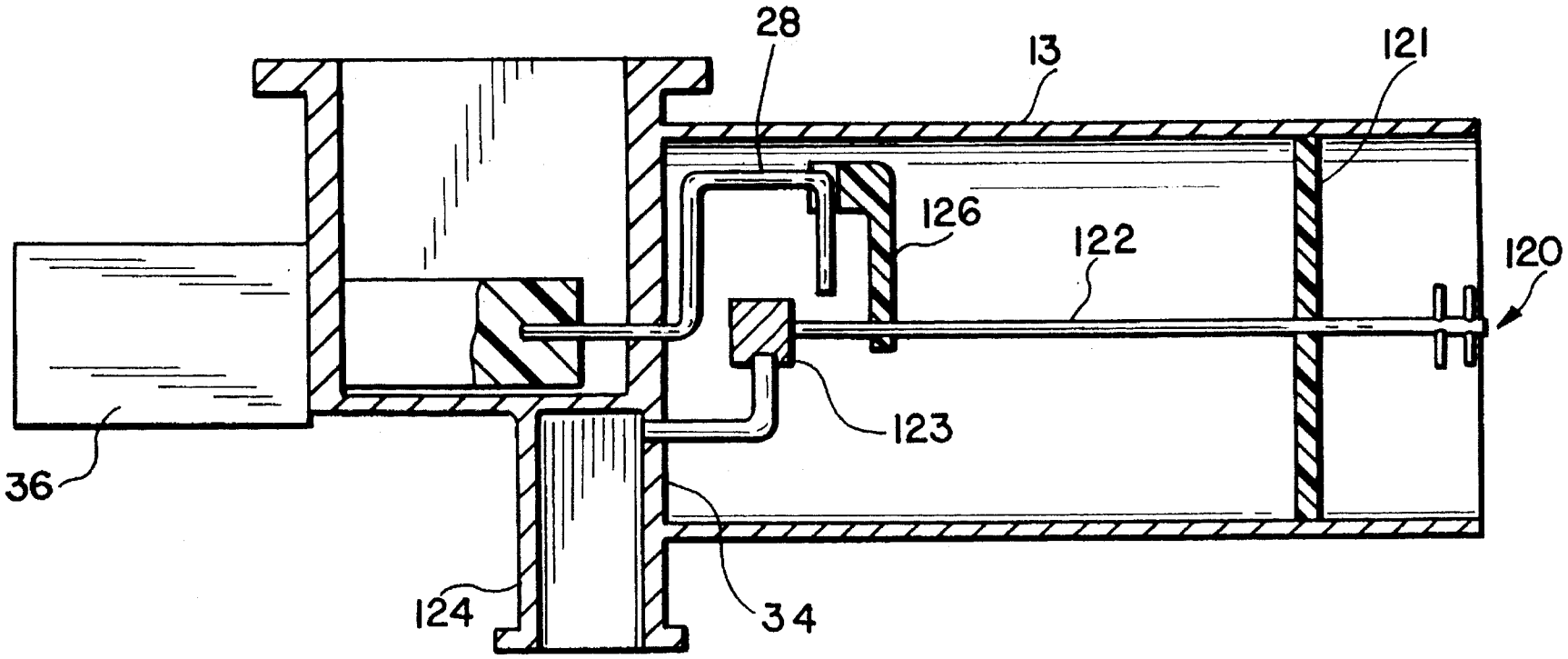
FIG. 5 is a side elevation sectional view of yet another embodiment of the present invention.

Referring to FIG. 5, there is shown yet another embodiment of the present invention. In this embodiment, the dipole feed, shown schematically by reference numeral 120, is rotatably held by a suitable plastic support 121 at the aperture of the C-band waveguide 13. The transmission line 122 for the Ku-band signal extends rigidly along the centerline of the C-band waveguide to a waveguide coupler 123 near the rear wall 34 of the C-band waveguide. The coupler 123 contains a rotary joint of a type well understood by those skilled in the relevant art. The Ku signal is coupled out of the C-band waveguide to a rectangular launch box 124 from where it is extracted for further processing. The C-band probe assembly 28 is fitted with a plastic arm 126 which may be substantially L-shaped and which is fixedly connected both to the probe assembly 28 at one end and to the rigid transmission line of the dipole feed at its other end. In this way, rotational movement of the probe assembly 28 is transmitted directly to the transmission line 122 and hence to the dipole feed 120 for purposes of polarization switching. In other respects, this embodiment is not substantially different from the other embodiments of the present invention.

With reference to FIGS. 1 and 7A, it will be understood that the planar surfaces 71 and 72 of the metal corner reflector comprising part of the dipole feed are obliquely arranged relative to each other, preferably at an angle of substantially 120 degrees. The direction of the angle relative to the dipole antenna arms, moreover, is such that the lateral edge boundaries of the planar surfaces 71 and 72 define a plane which substantially contains the driven dipole arms 16, as shown in FIGS. 2 and 3. It has been found that this particular angle between the plates of the corner reflector serves to shape the radiation pattern in the E and H planes for the dipole feed so that it is substantially rotationally symmetrical and to minimize the return loss effect on the C-band signal within the circular waveguide 13. The unusual 120 degree angle for the corner reflector provides a beneficially narrow Ku-band pattern with less effect on the C-band return loss than would be otherwise expected. In essence, it has been found that such an arrangement provides better and more efficient illumination of the parabolic reflector dish.

It is important to note that the dipole feed of the present invention is not situated within a waveguide and does not require the presence of a waveguide in order to produce a suitably symmetrical and narrow radiation pattern. The present dipole feed does not have a physical aperture with an electric field established therein by an incident TE11 mode, as is true with waveguide antennas. The dipole feed functions essentially in free space, without substantial influence from the nearby C-band waveguide. A TE11 mode, in contrast, cannot exist in free space. It can only exist within the waveguide. While a simple dipole can be used to excite and couple to a TE11 mode if it is within a waveguide, as disclosed by Seavey, a probe of the type disclosed by Howard or Mitchell et al. could not be substituted for the driven dipole arms in the Ku-band dipole feed of the present invention and achieve the desired results without further experimentation and adjustment or addition of other components or features.

It is apparent that those skilled in the art may make modification to the specific embodiments described herein without departing from the scope of the invention. Accordingly, the invention is not to be limited except by the spirit and scope of the following claims.

What is claimed is:

1. A dual band feed assembly comprising:

a waveguide to propagate lower frequency signals having a rim defining an aperture in which the lower frequency microwave signals are incident;

an antenna assembly of interactive elements responsive to higher frequency signals independent of and mounted coaxially with the lower frequency waveguide, said interactive elements comprising emitting and reflecting pairs of oppositely extending antenna arms, each arm of said reflecting pair of antenna arms being spaced from and parallel to one arm of said emitting pair of antenna arms, and a reflector element defining a reflective surface area adjacent and substantially parallel to each arm of said reflecting pair of antenna arms, said reflecting pair of oppositely extending antenna arms being closer to said reflective surface area than said emitting pair of antenna arms.

2. The dual band feed assembly of claim 1, wherein the arms of said emitting pair of antenna arms are substantially collinear.

3. The dual band feed assembly of claim 1, wherein the arms of said reflecting pair of antenna arms are substantially collinear.

4. The dual band feed assembly of claim 1, wherein said emitting and reflecting pairs of antenna arms are substantially coextensive.

5. The dual band feed assembly of claim 1, in which said reflective surface area extends substantially parallel to each arm of said emitting pair of antenna arms.

6. The dual band feed assembly of claim 1 in which said reflector element comprises a plate and said reflective surface area has a substantially planar section.

7. The dual band feed assembly of claim 6, wherein said reflector element comprises a pair of plates, and said reflective area constitutes a substantially planar section of each of said plates, said planar sections intersecting at a corner, each of said planar sections being substantially parallel to each arm of said reflecting pair of antenna arms.

8. The dual band feed assembly of claim 7, wherein each of said planar sections is substantially parallel to each arm of said emitting pair of antenna arms.

9. The dual band feed assembly of claim 8, wherein said reflecting pair of antenna arms is substantially parallel to the line of intersection between said planar sections.

10. The dual band feed assembly of claim 9, wherein said planar sections subtend an oblique angle relative to said emitting and reflecting pairs of antenna arms.

11. The dual band feed assembly of claim 10, wherein said planar sections subtend an angle of approximately 120 degrees relative to said emitting and reflecting pairs of antenna arms.

12. The dual band feed assembly of claim 1, wherein said emitting pair of antenna arms comprise a driven dipole antenna.

13. The dual band feed assembly of claim 1, wherein each arm of said reflecting pair of antenna arms comprises a parasitic element.

14. The dual band feed assembly of claim 1, wherein said interactive elements are fixedly mounted adjacent one end of a common tubular member.

15. The dual band feed assembly of claim 14, wherein a feed wire is electrically coupled to one arm of said emitting pair of antenna arms and extends longitudinally within said tubular member from said one end thereof, said feed wire terminating in a feed pin within said tubular member.

16. The dual band feed assembly of claim 15, comprising a coaxial line for transmission of higher frequency signals, said coaxial line extending longitudinally within said tubular member from the other end of said tubular member toward said feed pin, said tubular member being rotatable relative to said coaxial line.

17. The dual band feed assembly of claim 16, comprising a probe assembly in said lower frequency waveguide, and means for rotating both said tubular member and said probe assembly relative to said coaxial line.

18. The dual band feed assembly of claim 17, wherein said rotating means comprises a dielectric drive shaft fixedly engaging each of said tubular member and said probe assembly, whereby said tubular member and said probe assembly rotate together.

19. The dual band feed assembly of claim 18, wherein said dielectric drive shaft comprises a lower drive bar and an upper drive bar, said lower drive bar mounted with said probe assembly and said upper drive bar engaging said tubular member.

20. The dual band feed assembly of claim 19, wherein said upper drive bar comprises a laterally projecting portion having a bore extending therethrough in the direction of the longitudinal axis of said upper drive bar.

21. The dual band feed assembly of claim 8, wherein a plane containing the distal ends of said intersecting planar sections substantially contains each of the arms of said emitting pair of antenna arms.

22. The dual band feed assembly of claim 1, comprising means for rotating said higher frequency antenna assembly relative to said lower frequency waveguide.

23. The dual band feed assembly of claim 21, wherein each of said planar sections comprises a planar conductive surface.

24. The dual band feed assembly of claim 1 in which the relative positions of said lower frequency waveguide and higher frequency antenna assembly are such that their phase centers are substantially coincident.

25. The dual band feed assembly of claim 24 in which at least one active element of said interactive elements is substantially within the plane of the aperture of said lower frequency waveguide.

26. A dual band feed assembly comprising:

a lower frequency waveguide having a rim defining an aperture in which lower frequency microwave signals are incident;

a higher frequency antenna assembly of interactive elements mounted coaxially with the lower frequency waveguide, said interactive elements comprising first and second pairs of oppositely extending antenna arms, each arm of said second pair of antenna arms being spaced from and parallel to one arm of said first pair of antenna arms, and a reflector element having a reflective surface area adjacent and substantially parallel to each arm of said second pair of antenna arms, said second pair of oppositely extending antenna arms being closer to said reflective surface area than said first pair of antenna arms, wherein said interactive elements are fixedly mounted adjacent one end of a common tubular member, a feed wire electrically coupled to one arm of said first pair of antenna arms and extending longitudinally within said tubular member from said one end thereof, said feed wire terminating in a feed pin within said tubular member, further comprising a coaxial line for transmission of higher frequency signals, said coaxial line extending longitudinally within said tubular member from the other end of said tubular member toward said feed pin, said tubular member being rotatable relative to said coaxial line, further comprising a probe assembly in said lower frequency waveguide, and means for rotating both said tubular member and said probe assembly relative to said coaxial line, wherein said rotating means comprises a dielectric drive shaft fixedly engaging each of said tubular member and said probe assembly, whereby said tubular member and said probe assembly rotate together, said dielectric drive shaft comprising a lower drive bar and an upper drive bar, said lower drive bar being mounted with said probe assembly and said upper drive bar engaging said tubular member, said upper drive bar comprising a laterally projecting portion having a bore extending therethrough in the direction of the longitudinal axis of said upper drive bar, wherein said coaxial line for transmission of said higher frequency signals traverses said laterally projecting portion of said upper drive bar through said bore, said upper drive bar being rotatable relative to said coaxial line.

27. A dual band feed assembly comprising:

a lower frequency waveguide having a rim defining an aperture in which lower frequency microwave signals are incident;

a higher frequency antenna assembly of interactive elements mounted coaxially with the lower frequency waveguide, said interactive elements comprising first and second pairs of oppositely extending antenna arms, each arm of said second pair of antenna arms being spaced from and parallel to one arm of said first pair of antenna arms, and a reflector element having a reflective surface area adjacent and substantially parallel to each arm of said second pair of antenna arms, said second pair of oppositely extending antenna arms being closer to said reflective surface area than said first pair of antenna arms;

wherein said interactive elements are fixedly mounted adjacent one end of a common tubular member, and a feed wire is electrically coupled to one arm of said first pair of antenna arms and extends longitudinally within said tubular member from said one end thereof, said feed wire terminating in a feed pin within said tubular member, further comprising a coaxial line for transmission of higher frequency signals, said coaxial line extending longitudinally within said tubular member from the other end of said tubular member toward said feed pin, said tubular member being rotatable relative to said coaxial line, wherein the center conductor of said coaxial line defines a conductive pin extending toward but spaced from said feed pin.

28. The dual band feed assembly of claim 27, wherein both of said conductive pin and said feed pin are surrounded by a single metallic sleeve within said tubular member.

29. The dual band feed assembly of claim 28, comprising means for mounting said higher frequency antenna assembly against axial movement in the direction of said probe assembly.

* * * * *